US008262371B2

(12) United States Patent
Wang

(10) Patent No.: US 8,262,371 B2
(45) Date of Patent: Sep. 11, 2012

(54) PNEUMATIC CONTROL DEVICE FOR SUPPLYING HYDRAULIC FLUID

(76) Inventor: Wen-Feng Wang, Yuanli Township, Miaoli County (TW)

( * ) Notice: Subject to any disclaimer, the term of this patent is extended or adjusted under 35 U.S.C. 154(b) by 426 days.

(21) Appl. No.: 12/704,622

(22) Filed: Feb. 12, 2010

(65) Prior Publication Data

US 2011/0197750 A1 Aug. 18, 2011

(51) Int. Cl.
*F04B 17/00* (2006.01)

(52) U.S. Cl. ..... 417/401; 91/290; 91/327

(58) Field of Classification Search ..... 417/384, 417/385, 386, 387, 399, 401, 403; 91/281, 91/282, 290, 303, 315, 327
See application file for complete search history.

(56) References Cited

U.S. PATENT DOCUMENTS 3,079,900 A * 3/1963 Hunnicutt ..... 91/290
3,272,081 A * 9/1966 Vedder et al. ..... 91/228
3,489,100 A * 1/1970 Hill ..... 91/307
3,618,468 A * 11/1971 Gardner et al. ..... 91/6
3,726,185 A * 4/1973 Orr ..... 91/290
3,963,383 A * 6/1976 Hill ..... 417/401
4,042,311 A * 8/1977 Yonezawa ..... 417/401
4,452,573 A * 6/1984 Samuel ..... 417/401
5,341,723 A * 8/1994 Hung ..... 91/224
5,490,766 A * 2/1996 Zeck ..... 417/63
5,564,913 A * 10/1996 Lee ..... 417/397
6,386,841 B1 * 5/2002 Probst ..... 417/397
6,409,482 B1 * 6/2002 Fon ..... 417/399

* cited by examiner

*Primary Examiner* — Charles Freay
*Assistant Examiner* — Nathan Zollinger

(57) ABSTRACT

A pneumatic control device includes a base comprising a reservoir, a first check valve for only allowing hydraulic fluid to flow into the reservoir, and a second check valve for only allowing the fluid to flow out of the reservoir; a hollow cylinder comprising a spring biased piston; a body mounted to the cylinder thereunder and releasably secured to the base, the body comprising a stepped-diameter passageway with a poppet mounted therein; and a cover releasably secured onto the poppet. In response to feeding pressurized air into the cylinder, the fluid in the reservoir flows out during a first stroke of the piston, and the fluid is sucked back into the reservoir during an opposite second stroke of the piston. In one embodiment, the fluid is for actuating a machine vise.

2 Claims, 5 Drawing Sheets

PNEUMATIC CONTROL DEVICE FOR SUPPLYING HYDRAULIC FLUID

BACKGROUND OF THE INVENTION

1. Field of Invention

The invention relates to pneumatic and hydraulic devices and more particularly to a pneumatic control device for supplying hydraulic fluid to, for example, a machine vise.

2. Description of Related Art

Conventionally, a control device for a pneumatic control device for supplying hydraulic fluid is disposed externally. For example, conventional electrical drills and machine vases each has an external, pneumatic control device (e.g., poppet valve and associate components) for supplying hydraulic fluid thereto.

However, the well known pneumatic control device suffers from a couple of disadvantages. For example, the size of the device is greatly increased. This in turn reduces space available for other components. As a result, the conventional pneumatic control devices are bulky. Thus, a need for improvement exists.

SUMMARY OF THE INVENTION

It is therefore one object of the invention to provide a pneumatic control device for supplying hydraulic fluid comprising a base comprising a reservoir for storing hydraulic fluid, a first check valve for only allowing the hydraulic fluid to flow into the reservoir, and a second check valve for only allowing the hydraulic fluid to flow out of the reservoir; a hollow cylinder having a chamber defined therein and comprising a piston disposed in the chamber, a rod having a head attached to the piston and a bottom disposed in the reservoir, and a biasing member biased between the head of the rod and the base; a body mounted to the cylinder thereunder and releasably secured to the base, the body comprising a stepped-diameter passageway therethrough, the stepped-diameter passageway including first, second, and third steps, an annular first groove proximate the third step, an annular second groove distal the third step, an inlet port communicating the second groove and the atmosphere, a return line interconnecting the first step and the chamber, a relief port interconnecting the chamber and the first groove, and an outlet port communicating between the atmosphere and the third step; a poppet mounted in the passageway and comprising an annular enlarged head moveably disposed in the second step, the head of the poppet having an annular well, a first O-ring put on the well, a shallow riser on top of the head of the poppet, a shoulder between the riser and a circumference of the head of the poppet, the shoulder being in communication with the first step, annular first, second, third, and fourth toothed sections on a circumference of the poppet, annular first, second, third, and fourth troughs alternately disposed among the first, second, third, and fourth toothed sections, and three second O-rings each put on one of the second, third, and fourth trough; and a cover releasably secured onto the poppet to urge a third O-ring against the first step, wherein in response to feeding pressurized air into the chamber, the hydraulic fluid in the reservoir flows out during a first stroke of the piston, and the hydraulic fluid is sucked back into the reservoir during a second stroke of the piston, the second stroke of the piston being opposite the first stroke of the piston in a moving direction.

The invention has the following advantages. The occupied space of the assembled pneumatic control device is greatly decreased because the piston, the poppet and associated components thereof are assembled in the base, the cylinder, and the body. Moreover, the number of the components is decreased. Tube length is shortened. The probability of malfunction is decreased. It is easy for maintenance. Finally, the assembly is facilitated.

The above and other objects, features and advantages of the invention will become apparent from the following detailed description taken with the accompanying drawings.

DETAILED DESCRIPTION OF THE INVENTION

Figure 1:
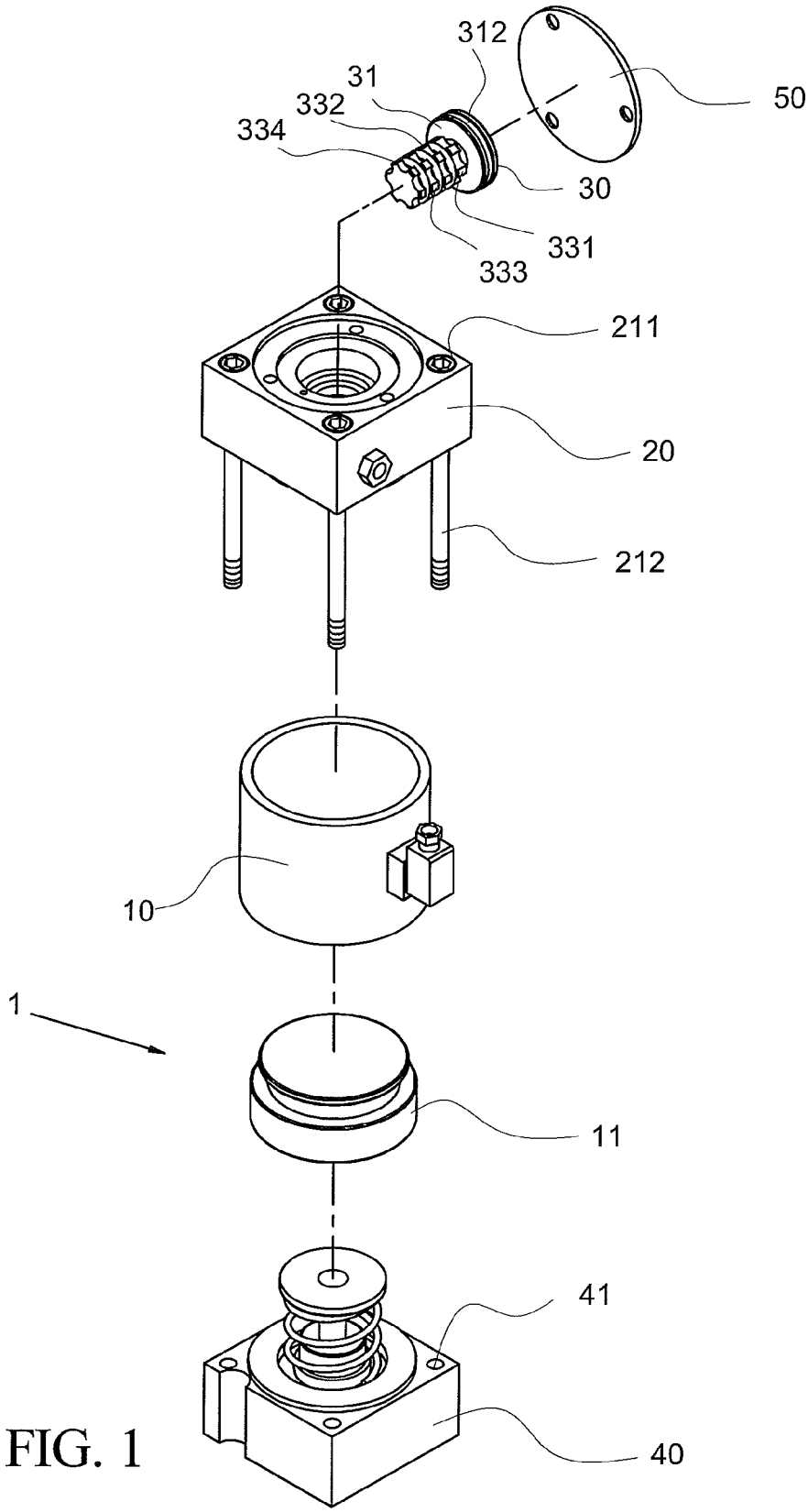
FIG. 1 is an exploded view of a preferred embodiment of pneumatic control device for supplying hydraulic fluid according to the invention.
Figure 2:
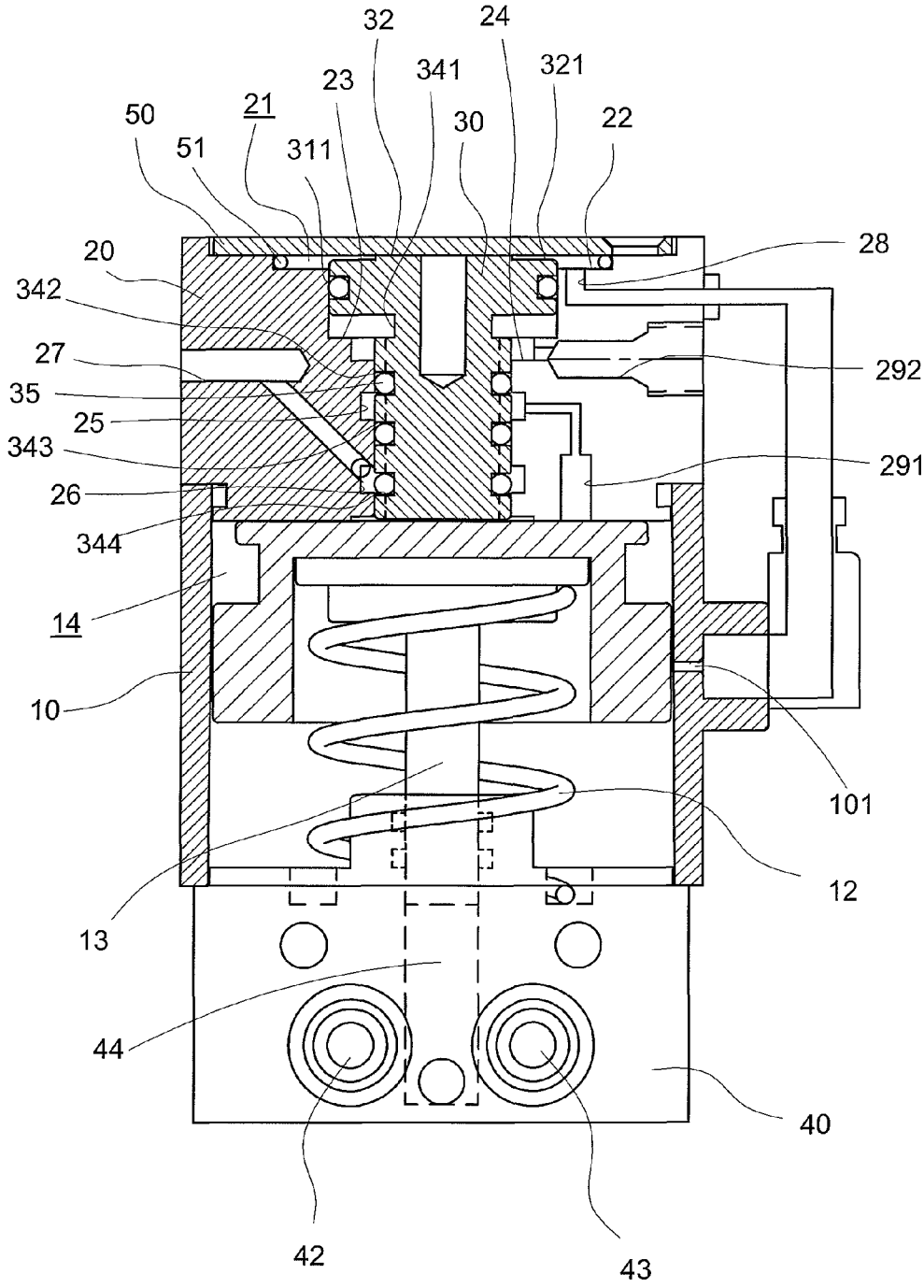
FIG. 2 is a longitudinal sectional view of the assembled pneumatic control device shown in FIG. 1.
Figure 3:
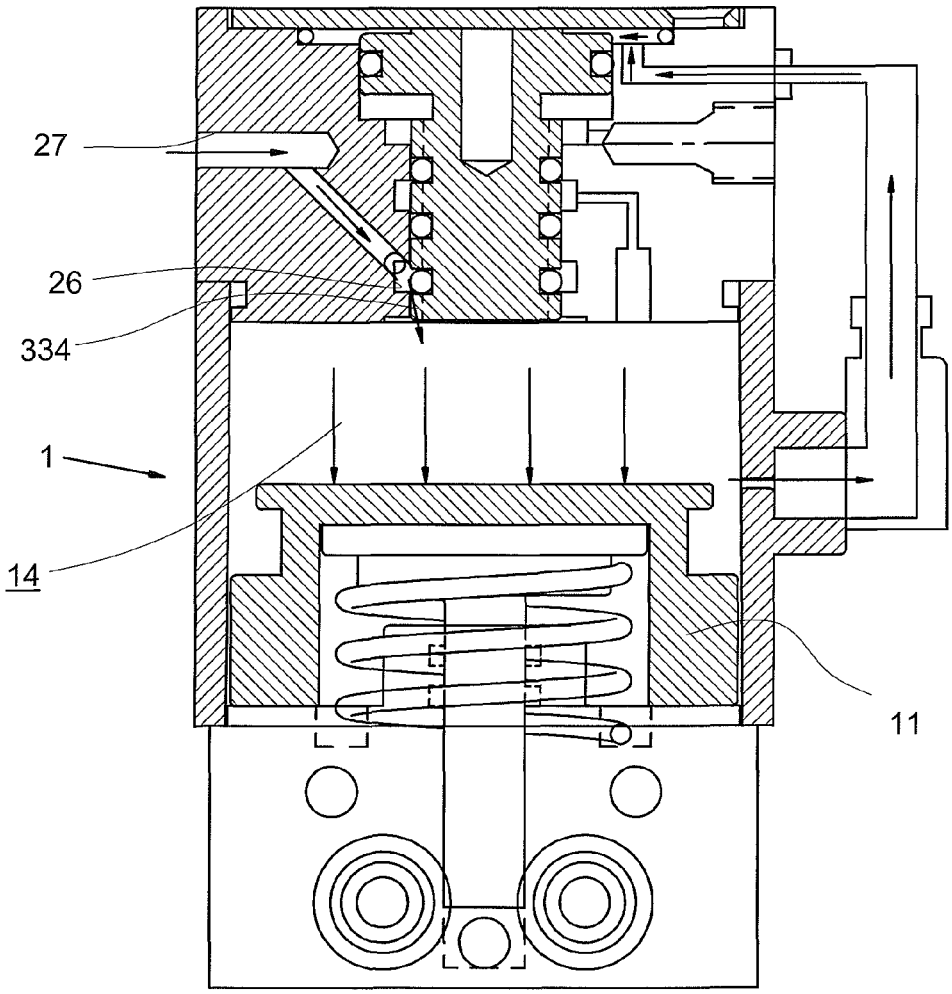
FIGS. 3 and 4 are views similar to FIG. 2 showing a complete cycle of the pneumatic control device for hydraulic fluid supplying.
Figure 4:
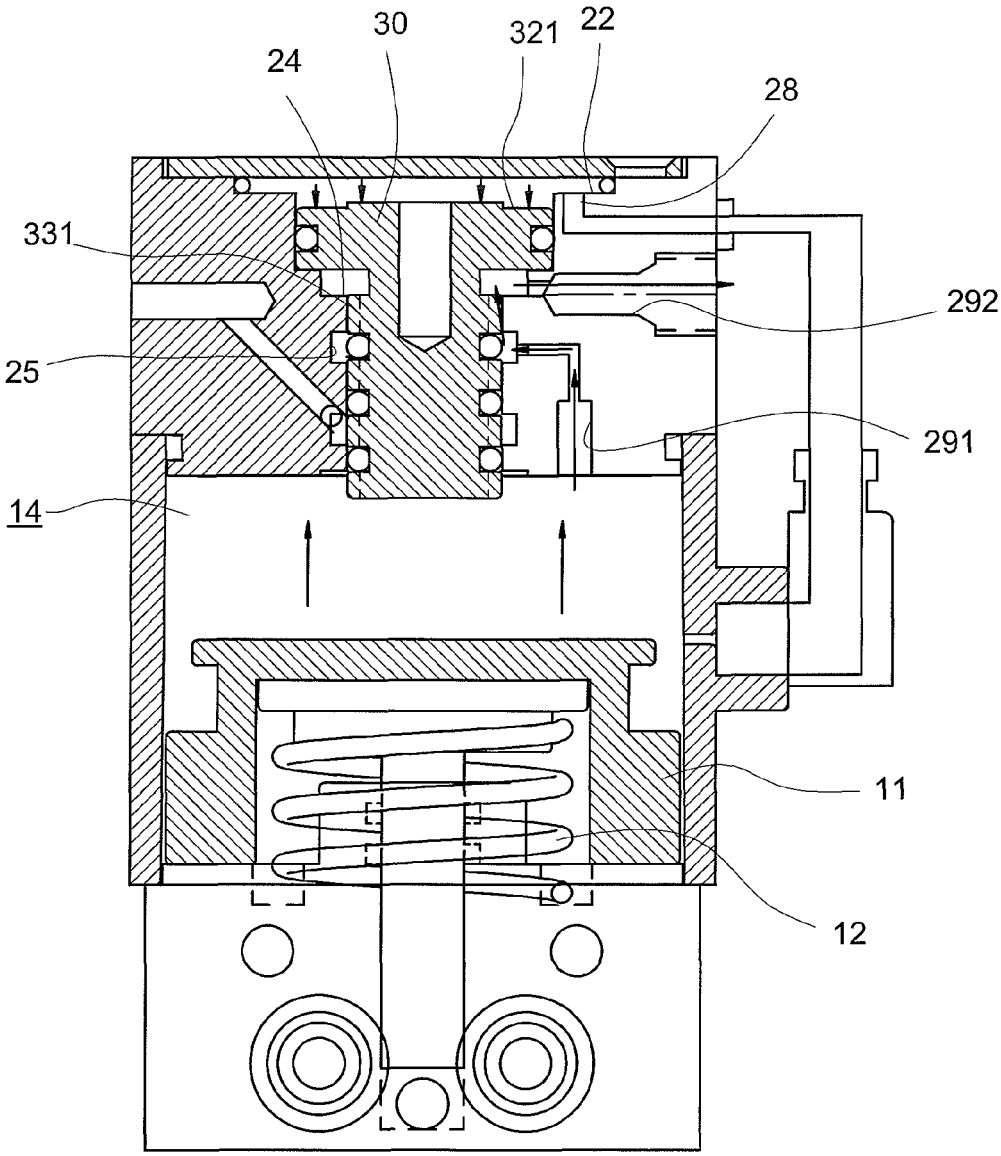
Figure 5:
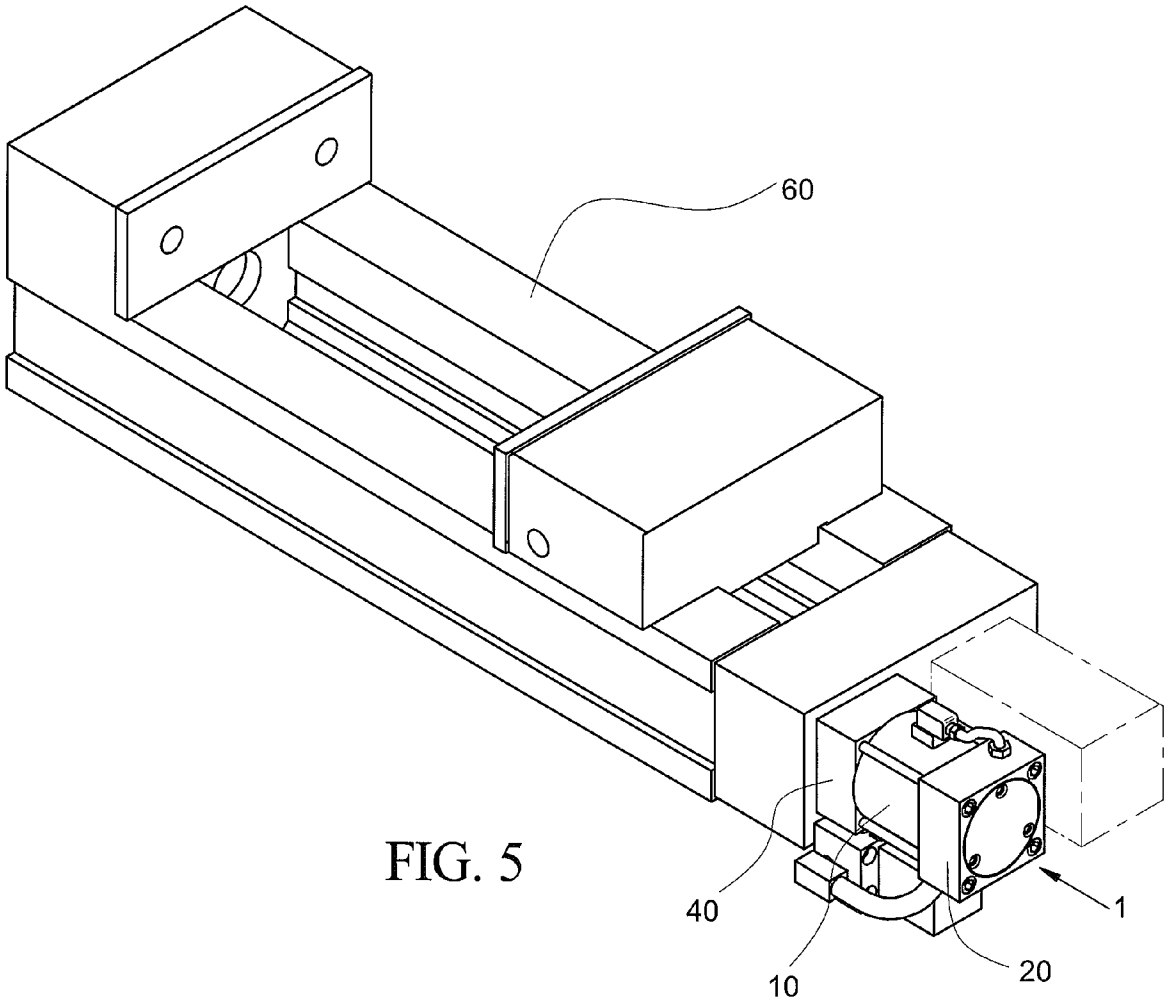
FIG. 5 is a perspective view of the pneumatic control device mounted to one end of a machine vise for supplying hydraulic fluid thereto.

Referring to FIGS. 1 to 5, a pneumatic control device 1 for supplying hydraulic fluid in accordance with a preferred embodiment of the invention is shown. The pneumatic control device 1 is mounted to one end of a machine vise 60. The pneumatic control device 1 comprises the following components as discussed in detail below.

A hollow cylinder 10 comprises a piston 11 provided in a chamber 14 in the cylinder 10 so as to separate the chamber 14 from a central reservoir 44 (for storing hydraulic fluid) in a rectangular base 40. A rod 13 has an enlarged head attached to a recessed bottom of the piston 11 and a bottom disposed in the reservoir 44. A bias spring (e.g., compression spring) 12 is biased between the head of the rod 13 and the base 40 so that the piston 11 may move forth and back in the cylinder 10 when the bias spring biased rod 13 moves as described in detail later.

A rectangular body 20 comprises a central stepped-diameter passageway 21 including first, second, and third steps 22, 23, and 24 proximate the mouth, an annular first groove 25 adjacent the third step 24, an annular second groove 26 distal the third step 24, an inlet port 27 communicating between the second groove 26 and the external, a return line 28 interconnecting the first step 22 and the chamber 14, a relief port 291 interconnecting the chamber 14 and the first groove 25, and an outlet port 292 communicating between the external atmosphere and the third step 24.

A pin-shaped poppet 30 comprises an annular enlarged head 31 moveably disposed in the second step 23, the head 31 having an annular well 311 on the circumference, an O-ring 312 put on the well 311, a shallow riser 32 on the top of the head 31, a shoulder 321 between the riser 32 and the circumference of the head 31, the shoulder 321 being in communication with the first step 22, annular first, second, third, and fourth toothed sections 331, 332, 333, and 334 on the shank of the poppet 30, annular first, second, third, and fourth troughs 341, 342, 343, and 344 alternately disposed among the first, second, third, and fourth toothed sections 331, 332, 333, and 334, and three O-rings 35 each put on one of the second, third, and fourth trough 342, 343 or 344. The poppet 30 is mounted in the passageway 21.

The cylinder 10 is mounted under the body 20. An O-ring 51 is rested upon the first step 22. A disc-shaped cover 50 is fastened on the poppet 30 and urged against the O-ring 51 by driving a plurality of screws (not shown) through the cover 50 into three threaded holes (not numbered) of the poppet 30. Also, a plurality of screws 212 are driven through four threaded holes 211 in the four corners of the body 20 into four threaded holes 41 in the four corners of the base 40. As a result, the body 20, the cylinder 10, and the base 40 are assembled together.

The base 40 further comprises a first check valve 42 for allowing fluid to flow into the reservoir 44 only and a second check valve 43 for allowing fluid to flow out of the reservoir 44 only.

It is envisaged by the invention that the occupied space of the assembled pneumatic control device 1 is greatly decreased (e.g., about one half space reduction as compared with the conventional pneumatic control device) because the piston 11, the poppet 30 and associated components thereof are assembled in the base 40, the cylinder 10, and the body 20. Moreover, the invention can decrease the number of the components, shorten tube length, decrease the probability of malfunction, increase the easiness of maintenance, and facilitate assembly.

Operation of the invention will be described in detail below. Pressurized air enters the chamber 14 via the inlet port 27, the second groove 26, and gaps between any two adjacent teeth of the fourth toothed section 334. And in turn, the piston 11 moves downward (as indicated by arrows in FIG. 3) by the downward flow of the pressurized air. The rod 13 further moves into the reservoir 44. Hydraulic fluid in the reservoir 44 is thus forced to flow out to activate the machine vise 60 via the second check valve 43.

The piston 11 will stop its downward movement when it reaches its bottom dead point. Shortly before reaching the bottom dead point pressurized air in the chamber 14 flows to the return line 28 via an orifice 101 of the body 20 (see arrows in FIG. 3). Eventually, the pressurized air reaches the first step 22 and the shoulder 321 to push the poppet 30 downward. A passage from the first groove 25 to the outlet port 292 is open due to the downward movement of the first toothed section 331. The pressurized air in the chamber 14 then flows to the atmosphere for exit via the relief port 291, the first groove 25, the third step 24, and the outlet port 292 (see arrows in FIG. 4). Atmospheric pressure in the chamber 14 thus gradually decreases. The piston 11 will move upward due to the expansion of the bias spring 12 if the expansion force of the bias spring 12 is greater than the atmospheric pressure in the chamber 14 (see arrows in FIG. 4). The upward moving piston 11 will contact the poppet 30 and push upward to return the poppet 30 to its inoperative position. At the same time, air in the space defined between the cover 50 and the poppet 30 gradually is forced to flow back to the return line 28. At this inoperative position, the upward movement of the piston 11 is stopped. Also, the bias spring 12, the rod 13, and the piston 11 return to their inoperative positions. It is noted that hydraulic fluid is sucked back from the machine vise 60 to the reservoir 44 via the first check valve 42 during the upward stroke of the piston 11. This completes the operating cycle of the invention.

While the invention herein disclosed has been described by means of specific embodiments, numerous modifications and variations could be made thereto by those skilled in the art without departing from the scope and spirit of the invention set forth in the claims.

What is claimed is:

1. A pneumatic control device for supplying hydraulic fluid comprising:

a base comprising a reservoir for storing hydraulic fluid, a first check valve for only allowing the hydraulic fluid to flow into the reservoir, and a second check valve for only allowing the hydraulic fluid to flow out of the reservoir;

a hollow cylinder having a chamber defined therein and comprising a piston disposed in the chamber, a rod having a head attached to the piston and a bottom disposed in the reservoir, and a biasing member biased between the head of the rod and the base;

a body mounted to the hollow cylinder thereunder and releasably secured to the base, the body comprising a stepped-diameter passageway therethrough, the stepped-diameter passageway including first, second, and third steps, an annular first groove proximate the third step, an annular second groove distal the third step, an inlet port communicating the second groove and the atmosphere, a return line interconnecting the first step and the chamber, a relief port interconnecting the chamber and the first groove, and an outlet port communicating between the atmosphere and the third step;

a poppet mounted in the passageway and comprising an annular enlarged head moveably disposed in the second step, the head of the poppet having an annular well, a first O-ring put on the well, a shallow riser on top of the head of the poppet, a shoulder between the riser and a circumference of the head of the poppet, the shoulder being in communication with the first step, the poppet further comprising annular first, second, third, and fourth toothed sections on another circumference of the poppet, with annular first, second, third, and fourth troughs alternately disposed among the first, second, third, and fourth toothed sections, and three second O-rings each put on one of the second, third, and fourth troughs; and a cover releasably secured onto the poppet to urge a third O-ring against the first step, wherein in response to feeding pressurized air into the chamber, the hydraulic fluid in the reservoir flows out during a first stroke of the piston, and the hydraulic fluid is sucked back into the reservoir during a second stroke of the piston, the second stroke of the piston being opposite the first stroke of the piston in a moving direction.

2. The pneumatic control device of claim 1, wherein the biasing member is a compression spring.

* * * * *